US010073384B2

(12) United States Patent
Portnoy et al.

(10) Patent No.: US 10,073,384 B2
(45) Date of Patent: Sep. 11, 2018

(54) PRINT BLANKET TEMPERATURE CONTROL DURING PAUSE PHASES

(71) Applicant: HEWLETT-PACKARD INDIGO B.V., Amstelveen (NL)

(72) Inventors: Vitaly Portnoy, Nes Ziona (IL); Michel Assenheimer, Kfar Sava (IL); Amiran Lavon, Bat Yam (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/320,395

(22) PCT Filed: Jun. 30, 2014

(86) PCT No.: PCT/EP2014/063879
§ 371 (c)(1),
(2) Date: Dec. 20, 2016

(87) PCT Pub. No.: WO2016/000748
PCT Pub. Date: Jan. 7, 2016

(65) Prior Publication Data
US 2017/0160678 A1 Jun. 8, 2017

(51) Int. Cl.
*G03G 15/00* (2006.01)
*G03G 15/16* (2006.01)

(52) U.S. Cl.
CPC ..... *G03G 15/161* (2013.01); *G03G 15/1605* (2013.01)

(58) Field of Classification Search
CPC ..... G03G 15/161; G03G 15/1605
USPC ..... 399/237
See application file for complete search history.

(56) References Cited

U.S. PATENT DOCUMENTS

| | | | | |
|---|---|---|---|---|
| 5,066,988 | A | 11/1991 | Miyake | |
| 5,272,975 | A * | 12/1993 | Dettinger | B41F 13/40 101/218 |
| 6,018,140 | A | 1/2000 | Hirose et al. | |
| 7,022,944 | B2 | 4/2006 | Yoshinaga et al. | |
| 8,027,608 | B2 | 9/2011 | Mukai et al. | |
| 2006/0222421 | A1 | 10/2006 | Holstun | |
| 2012/0155907 | A1 | 6/2012 | Tanaka | |
| 2012/0312179 | A1 * | 12/2012 | Scheade | B41F 9/021 101/153 |

FOREIGN PATENT DOCUMENTS

| | | |
|---|---|---|
| JP | S60225182 | 11/1985 |
| JP | H0392881 | 4/1991 |
| JP | 2008179028 | 8/2008 |
| WO | WO-2013132418 | 9/2013 |

OTHER PUBLICATIONS

Bartolic, T. et al., Impact of Printing Additional Inks on Multicolor Reproduction in Liquid Toner Electrophotography, Jun. 27-29, 2013. http://bib.irb.hr/datoteka/635350.3_Bartolic_Majnaric_Bolanca.pdf.

* cited by examiner

*Primary Examiner* — Quana M Grainger
(74) *Attorney, Agent, or Firm* — HP Inc. Patent Department

(57) ABSTRACT

In an example, a method of controlling the temperature of a print blanket within a printing device includes printing a print job. During the printing, a pause phase start trigger is sensed. In response to sensing the pause phase start trigger, a set-point of a print blanket heating lamp is changed from a print set-point to a pause set-point to control the print blanket temperature during the pause phase.

20 Claims, 3 Drawing Sheets

PRINT BLANKET TEMPERATURE CONTROL DURING PAUSE PHASES

CROSS-REFERENCE TO RELATED APPLICATION

This application is a U.S. National Stage Application of and claims priority to International Patent Application No. PCT/EP2014/063879, filed on Jun. 30, 2014, and entitled "PRINT BLANKET TEMPERATURE CONTROL," which is hereby incorporated by reference in its entirety.

BACKGROUND

Electro-photography (EP) printing devices form images on media by selectively discharging a photoconductive drum in correspondence with the images. The selective discharging of the photoconductive drum forms a latent image on the drum. Colorant is then developed onto the latent image of the drum, and the colorant is ultimately transferred to the media to form the image on the media. In dry EP (DEP) printing devices, toner is used as the colorant, and it is received by the media as the media passes below the photoconductive drum. The toner is then fixed in place as it passes through heated pressure rollers. In liquid EP (LEP) printing devices, ink is used as the colorant instead of toner. In LEP devices, an ink image developed on the photoconductive drum is offset to an image transfer element, where it is heated until the solvent evaporates and the resinous colorants melt. This image layer is then transferred to the surface of the media in the form of an image or text.

The image transfer element includes a consumable print blanket that can sustain damage during the LEP printing process.

BRIEF DESCRIPTION OF THE DRAWINGS

The present embodiments will now be described, by way of example, with reference to the accompanying drawings, in which.

Throughout the drawings, identical reference numbers designate similar, but not necessarily identical, elements.

DETAILED DESCRIPTION

Figure 1:
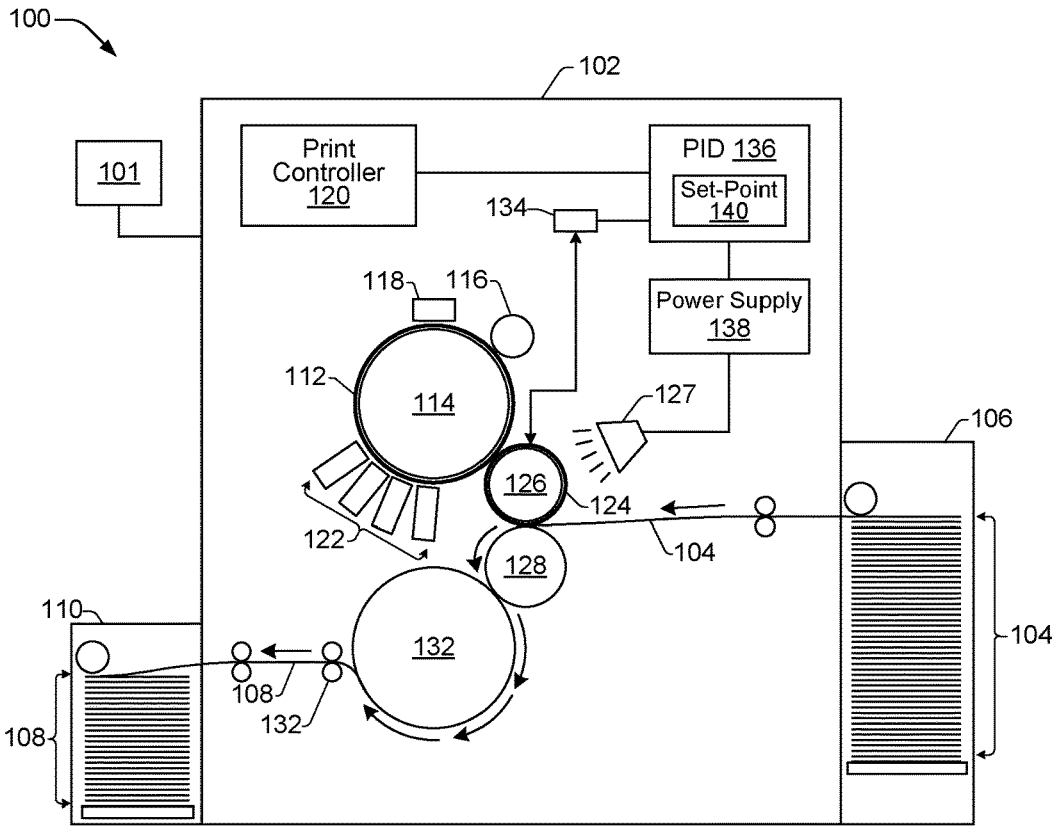
FIG. 1 shows an example of a printing device suitable for controlling the temperature of a print blanket within the device to avoid a temperature overshoot in the blanket that exceeds a normal blanket printing temperature.

A liquid electro-photographic (LEP) printing device is a digital offset press that uses electrically charged ink with a thermal offset print blanket. In an LEP printing press, the surface of a photo imaging component is selectively discharged using photo-induced electric conductivity and a laser beam to form a latent image. The photo imaging component is often referred to as a "photoconductor" or a "photoreceptor", and it will be referred to as such for the remainder of this description. Charged liquid ink is then applied to the surface of the photoreceptor, forming an ink image. The charged ink is attracted to locations on the photoreceptor where surface charge has been neutralized by the laser, and rejected from locations on the photoreceptor where surface charge has not been neutralized by the laser. The ink image is then transferred from the surface of the photoreceptor to an intermediate transfer media (ITM, referred to herein as the "blanket", or "print blanket"). Transferring the ink image from the photoreceptor to the print blanket is often referred to as the "first transfer". In a "second transfer," the ink image is then transferred from the print blanket to the print media (e.g., sheet paper, web paper) by pressing the media being held on an impression drum against the blanket. During this printing process, the blanket is heated and maintained at a high temperature in order to evaporate solvents present in the liquid ink and to partially melt and blend solid ink particles. The high blanket temperature also facilitates the second transfer of the image onto the print media.

There are various blanket wear mechanisms that can damage the print blanket, which in turn, can have a negative impact on print quality. Damage to a print blanket caused by such wear mechanisms effectively shortens the useful lifespan of the blanket, since printing press operators typically replace print blankets when the print quality begins to suffer. Unfortunately, replacing print blankets is expensive and reduces printer output efficiency because of the time involved in the replacement process.

One common blanket wear mechanism is referred to as blanket memory. Blanket memory can cause damage to a blanket through the continual placement of the same or similar images in the same position on the blanket. As the number of these printed images increases, the blanket wear increases and eventually appears as a defect on other printed images. Another blanket wear mechanism is the repeated pressing of the print media against the blanket, which causes the sharp edges of the media to cut into the blanket. Cut-marks that develop in the blanket can result in a poor transfer of ink within the cut-marks to the print media when subsequently printing larger images that extend beyond the cut-marks. The cut-marks can eventually become visible defects on the printed output. Yet another blanket wear mechanism is the high temperature at which the blanket is maintained. In particular, the high temperature at which the blanket is maintained during printing, along with variations in the blanket temperature that can increase the temperature of the blanket beyond its normal printing temperature, can cause damage to the blanket such as blanket cracks from over-drying of the blanket. The high blanket temperature and temperature variation can also increase the damage caused by other wear mechanisms, such as increasing blanket cut-marks caused by repeated pressing of the print media against the blanket.

Temperature variations in the blanket that overshoot the normal printing temperature of the blanket can be particularly damaging to the blanket. One event that can cause a temperature overshoot in the blanket temperature is a pause phase, which can occur unpredictably during printing. A pause phase is a brief period of time during which the printing press enters a non-active state where it ceases active printing, but remains in a ready condition to resume printing quickly. In some examples, a pause phase can have a timeout duration of up to approximately five minutes. Thus, a pause phase will not continue indefinitely, and if the pause phase does not conclude before the timeout duration elapses, the printing press will transition to a lower state, such as a standby state. In a standby state, a standby temperature is typically activated which turns off the heat to the blanket. Common triggers for a pause phase include both operator-generated triggers and printing press-generated triggers. For example, an operator may manually trigger a pause in printing in order to recalibrate the press for job related parameters. The press will remain in the pause phase until the operator releases the pause phase, after which the press can resume printing. In another example, a component of the printing press can automatically trigger a pause in printing in order to notify the operator that the print media supply has run out and needs to be replenished. Once the media supply is replenished, the component may automatically trigger an end to the pause phase so the press can continue printing.

In either case, a pause phase trigger initiates several events within the printing press that are intended to reduce damage to consumable components within the press (e.g., the print blanket), while still maintaining the press in a ready condition to resume printing quickly. Thus, press elements that are capable of quick reactivation can be deactivated during a pause phase, while elements that cannot be quickly reactivated are typically not deactivated. For example, drums within the press (i.e., the photoreceptor/imaging drum, ITM drum, impression drum) continue to rotate during a pause phase, but they are disengaged from one another. Because the print blanket on the ITM drum is being maintained at a high temperature during printing (i.e., blanket is being continually heated from an internal and external heating source), the sudden initiation of a pause phase in which the blanket is disengaged from the impression drum causes a significant increase in the temperature of the blanket. During normal printing, contact between the print blanket and the impression drum causes heat from the blanket to continually dissipate or transfer to the impression drum. In addition, the transfer of the hot, tacky plastic, finished ink image from the blanket to the print media on the impression drum transfers significant heat away from the blanket. Because the blanket is suddenly disengaged from the impression drum at the onset of a pause phase, these mechanisms that normally transfer heat away from the print blanket are no longer present. Other mechanisms can also affect heat transfer away from the blanket, such as fans and air flow valve controls that can cause sudden heat dissipation changes. These heat transfer changes can cause an increase in the blanket temperature which overshoots the normal printing temperature of the blanket. A temperature control loop mechanism that maintains the blanket temperature at a normal printing temperature, is not able to compensate for the sudden increase in blanket temperature during a pause phase. The resulting temperature overshoot is damaging to the blanket.

The temperature control loop for the blanket maintains the blanket at a printing temperature during normal printing. Parameters of the control loop are selected to effectively allow for a constant blanket temperature during print, even in the presence of perturbations such as variations in ink coverage on the blanket, variations in air flow from fans, small discontinuities in the drums where the blanket is attached via clamps, changes in paper thickness (which changes the heat dissipated by the paper), paper temperature changes, heating up of the impression drum, and so on. The control loop parameters are selected to optimally accommodate such variations. Several of these variations occur rapidly, and therefore require a rapid response from the press controller. However, rapid response control leads to temperature overshoots when sudden large variations occur, such as when the press enters a pause phase. The variation caused by the pause phase is too large to allow for a single set of control parameters in the temperature control loop. Slower control response, which would reduce or eliminate the temperature overshoot, would not be effective in compensating for the other variations. Therefore, it is not possible to accommodate all types of variations effectively using a single set of control loop parameters.

Accordingly, example systems and methods described herein detect the onset of a pause phase (i.e., a pause in the printing) and make a proactive adjustment to a control loop set-point of a heating lamp within a blanket temperature control loop in order to avoid an overshoot of the blanket temperature. When a pause phase trigger is detected, a set-point of the heating lamp (e.g., an external temperature set-point, a power set-point) can be reduced to eliminate the blanket temperature overshoot while not increasing the time it takes to resume printing (i.e., the "back-to-print" time).

In one example, a method of controlling the temperature of a print blanket within a printing device includes printing a print job. During the printing of the print job, a pause phase start trigger is sensed. Then, in response to sensing the pause phase start trigger, a set-point of a print blanket heating lamp is changed from a print set-point to a pause set-point in order to control the print blanket temperature. In different examples, changing the set-point can include changing a temperature set-point of the print blanket heating lamp, or changing a power set-point of the print blanket heating lamp. In another example, a printing device includes a print blanket to receive an ink image from a photoreceptor. The printing device also includes a heating lamp to heat the print blanket and prepare the ink image for transfer to a print media. The printing device also includes a controller to receive a pause trigger and to reduce a temperature set-point of the heating lamp in response to the trigger. In another example, a non-transitory machine-readable storage medium stores instructions that when executed by a processor of a printing device, cause the printing device to receive a pause trigger during the printing of a print job. In response to the pause trigger, the instructions cause the printing device to reduce an external temperature set-point of a print blanket to control the print blanket temperature during a pause phase. The printing device further receives a resume trigger, and, in response to the resume trigger, the printing device increases the external temperature set-point to control the print blanket temperature during a print phase.

FIG. 1 illustrates an example of a printing device 100 suitable for controlling the temperature of a print blanket within the device to avoid a temperature overshoot in the blanket that exceeds a normal blanket printing temperature. The printing device 100 comprises a print-on-demand device, implemented as a liquid electro-photography (LEP) printing press 100. An LEP printing press 100 generally includes a user interface 101 that enables the press operator to manage various aspects of printing, such as loading and reviewing print jobs, proofing and color matching print jobs, reviewing the order of the print jobs, and so on. The user interface 101 typically includes a touch-sensitive display screen that allows the operator to interact with information on the screen, make entries on the screen, and generally control the press 100. In one example, the user interface 101 enables the press operator to manually initiate a pause phase that temporarily suspends printing, and then to end the pause phase in order to resume printing. A user interface 101 may also include other devices such as a key pad, a keyboard, a mouse, and a joystick, for example.

An LEP printing press 100 includes a print engine 102 that receives a print substrate, illustrated as print media 104 (e.g., cut-sheet paper or a paper web) from a media input mechanism 106. After the printing process is complete, the print engine 102 outputs the printed media 108 to a media output mechanism, such as a media stacker tray 110. The printing process is generally controlled by a print controller 120 to generate the printed media 108 using digital image data that represents words, pages, text, and images that can be created, for example, using electronic layout and/or desktop publishing programs. Digital image data is generally formatted as one or more print jobs stored and executed on print controller 120, as further discussed below with reference to FIG. 2.

The print engine 102 includes a photo imaging component, such as a photoreceptor 112 mounted on an imaging drum 114 or imaging cylinder 114. The photoreceptor 112 defines an outer surface of the imaging drum 114 on which images can be formed. A charging component such as charge roller 116 generates electrical charge that flows toward the photoreceptor surface and covers it with a uniform electrostatic charge. The print controller 120 uses digital image data to control a laser imaging unit 118 to selectively expose the photoreceptor 112. The laser imaging unit 118 exposes image areas on the photoreceptor 112 by dissipating (neutralizing) the charge in those areas. Exposure of the photoreceptor creates a 'latent image' in the form of an invisible electrostatic charge pattern that replicates the image to be printed.

After the latent/electrostatic image is formed on the photoreceptor 112, the image is developed by a binary ink development (BID) roller 122 to form an ink image on the outer surface of the photoreceptor 112. Each BID roller 122 develops one ink color in the image, and each developed color corresponds with one image impression. While four BID rollers 122 are shown, indicating a four color process (i.e., a CMYK process), other press implementations may include additional BID rollers 122 corresponding to additional colors. In addition, although not illustrated, print engine 102 includes an erase mechanism and a cleaning mechanism which are generally incorporated as part of any electrophotographic process. In a first image transfer, the single color separation impression of the ink image developed on the photoreceptor 112 is transferred electrically and by pressure from the photoreceptor 112 to an image transfer blanket 124. The image transfer blanket 124 is primarily referred to herein as the print blanket 124 or blanket 124. The ink layer is transferred electrically and by pressure to the blanket 124 as the photoreceptor 112 rotates into contact with the electrically charged blanket 124 rotating on the ITM drum 126, or transfer drum 126. The print blanket 124 is electrically charged through the transfer drum 126. The print blanket 124 overlies, and is securely attached to, the outer surface of the transfer drum 126.

The print blanket 124 is heated both by an internal heating source within the ITM/transfer drum 126, and from an external heating source such as an infrared heating lamp 127. The heating source within the drum 126 can also be infrared heating lamps (not illustrated). While the external heating lamp 127 is illustrated as a single lamp, this is not to be construed as a limitation regarding the number, type, or configuration of such a heating lamp. Rather, heating lamp 127 is intended to represent a range of suitable configurations of heating lamps. For example, heating lamp 127 can comprise one or multiple heating lamps in various configurations, such as multiple heating lamps configured in parallel that are controlled together or individually, such as where power can be changed to all of the heating lamps at once or to just one specific heating lamp. The heat from the heated blanket 124 causes most of the carrier liquid in the ink to evaporate, and it also causes the particles in the ink to partially melt and blend together. This results in a finished ink image in the form of a hot, nearly dry, tacky plastic ink film. In a second image transfer, this hot ink film image impression is then transferred to a substrate such as a sheet of print media 104, which is held by an impression drum/cylinder 128. The temperature of the print media substrate 104 is below the melting temperature of the ink particles, and as the ink film comes into contact with the print media substrate 104, the ink film solidifies, sticks to the substrate, and completely peels off from the blanket 124.

This process is repeated for each color separation in the image, and the print media 104 remains on the impression drum 128 until all the color separation impressions (e.g., C, M, Y, and K) in the image are transferred to the print media 104. After all the color impressions have been transferred to the sheet of print media 104, the printed media 108 sheet is transported by various rollers 132 from the impression drum 128 to the output mechanism 110.

As shown in FIG. 1, the LEP printing press 100 also includes a temperature sensor 134, a PID (proportional-integral-derivative) or other more sophisticated controller 136, and a power supply 138 to supply power to the external heating lamp 127. The external heating lamp 127, temperature sensor 134, PID 136, and power supply 138, form a temperature feedback control loop mechanism that monitors the temperature of the print blanket 124 and maintains the print blanket temperature at a printing temperature that is suitable for achieving the transfer of ink images from the photoreceptor 112 to the print media 104 on impression drum 128, as discussed above. While the print blanket temperature may vary, an example print blanket temperature during printing is 110° C. (degrees Celsius). To assure consistent print quality, the PID maintains the blanket temperature to within two to three degrees C. (i.e., plus or minus) of this normal printing temperature. Thus, during printing, the temperature sensor 134 senses the temperature of the print blanket 124 and provides the sensed temperature value to the PID 136. The PID 136 compares the sensed temperature value from sensor 134 with an external temperature set-point 140 that has been received, for example, from the print controller 120. A default value for the temperature set-point value might be, for example, 110° C. The PID 136 uses the comparison to control the power supply 138 in order to adjust the amount of power from the supply 138 to the external heating lamp 127. For example, the PID 136 can increase power from the supply 138 to the heating lamp 127 when the sensed temperature falls below the temperature set-point 140, and it can decrease power from the supply 138 to the heating lamp 127 when the sensed temperature falls below the temperature set-point.

Figure 2:
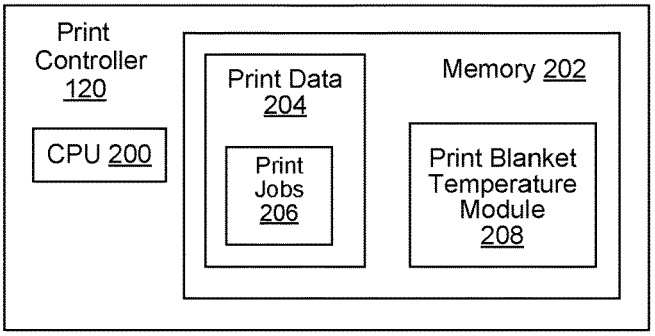
FIG. 2 shows a box diagram of an example print controller suitable for implementation within an LEP printing press to control a printing process and to facilitate temperature control of a print blanket.

FIG. 2 shows a box diagram of an example print controller 120 suitable for implementing within an LEP printing press 100 to control a printing process and to facilitate temperature control of a print blanket 124. Referring to FIGS. 1 and 2, print controller 120 generally comprises a processor (CPU) 200 and a memory 202, and may additionally include firmware and other electronics for communicating with and controlling the other components of print engine 102, the user interface 101, and media input (106) and output (110) mechanisms. Memory 202 can include both volatile (i.e., RAM) and nonvolatile (e.g., ROM, hard disk, optical disc, CD-ROM, magnetic tape, flash memory, etc.) memory components. The components of memory 202 comprise non-transitory, machine-readable (e.g., computer/processor-readable) media that provide for the storage of machine-readable coded program instructions, data structures, program instruction modules, JDF (job definition format), and other data for the printing press 100, such as module 208. The program instructions, data structures, and modules stored in memory 202 may be part of an installation package that can be executed by processor 200 to implement various examples, such as examples discussed herein. Thus, memory 202 may be a portable medium such as a CD, DVD, or flash drive, or a memory maintained by a server from which the installation package can be downloaded and installed. In another example, the program instructions, data structures, and modules stored in memory 202 may be part of an application or applications already installed, in which case memory 202 may include integrated memory such as a hard drive.

As noted above, print controller 120 uses digital image data to control the laser imaging unit 118 in the print engine 102 to selectively expose the photoreceptor 112. More specifically, controller 120 receives print data 204 from a host system, such as a computer, and stores the data 204 in memory 202. Data 204 represents, for example, documents or image files to be printed. As such, data 204 forms one or more print jobs 206 for printing press 100 that each include print job commands and/or command parameters. Using a print job 206 from data 204, print controller 120 controls components of print engine 102 (e.g., laser imaging unit 118) to form characters, symbols, and/or other graphics or images on print media 104 through a printing process as has been generally described above with reference to FIG. 1.

As previously mentioned, printing can be paused in the press 100 for various reasons. In different examples, a trigger indicating the start of a printing pause phase can be initiated by the press operator via the user interface 101, or, the trigger can be initiated by a component of the press itself (e.g., media input mechanisms, media transport mechanisms, media alignment mechanisms, etc.), signaling a need to pause the printing in order to manage various issues, such as replenishing a supply of print media. A pause phase trigger can be received or detected by the print controller 120, which can enable a print blanket temperature module 208 to respond to the trigger. The print blanket temperature module 208 comprises program instructions stored in memory 202 and executable on processor 200 to cause the print controller 120, and/or printing press 100, to receive a pause phase trigger and to initiate various actions that will help reduce damage to the print blanket during the pause in printing, while maintaining the press in a ready condition to resume printing quickly after the pause concludes. As discussed below, such actions can include changing heating lamp set-points within the PID 136 such as a temperature set-point of a heating lamp or a power supply set-point of a heating lamp, in order to avoid an increase in blanket temperature that overshoots the normal printing temperature of the blanket.

One action that can be taken by the print controller 120 during a pause phase is to disengage drums within the press 100. Thus, the photoreceptor/imaging drum 114, ITM drum 126, and impression drum 128, can be disengaged from one another, and the generation and transfer of images within the press 100 will therefore stop. The drums typically remain rotating in order to facilitate a faster printing start-up after the pause phase ends. As previously noted, however, disengaging the drums and ceasing the transfer of ink images off of the print blanket 124 cause a sudden decrease in the dissipation of heat from the blanket 124 and a corresponding increase in the blanket temperature. The temperature increase in the blanket can significantly overshoot a normal printing temperature of the blanket. In anticipation of this blanket temperature overshoot, module 208 includes instructions executing on print controller 120 to cause the controller 120 to change a set-point 140 of a heating lamp 127 within the PID 136. For example, the controller 120 can change an external temperature set-point 140 from a printing temperature set-point value to a pause temperature set-point value. A printing temperature set-point value will cause the PID 136 to control the power supply 138 to provide an amount of power to the heating lamp 127 during printing that maintains the blanket temperature (sensed by sensor 134) at a normal printing temperature. A pause temperature set-point value will cause the PID 136 to control the power supply 138 to provide a reduced amount of power to the heating lamp 127 during a pause phase. The reduced amount of power to the heating lamp 127 maintains the blanket temperature at or below the normal printing temperature during the pause phase. The pause temperature set-point value is reduced from the printing temperature set-point by an amount that ensures a constant blanket temperature, irrespective of whether the press is in print mode or a pause phase. The pause temperature set-point value is generally lower than the printing temperature set-point by an amount that enables a return to normal blanket printing temperature within a minimum back-to-print time (i.e., the time between the end of the pause phase and the resumption of printing). For example, while a printing temperature set-point can be 110° C. to maintain the blanket temperature at a proper printing temperature, a pause temperature set-point might be 90° C., which will avoid a blanket temperature overshoot while still enabling the blanket temperature to return to a printing temperature within a minimum back-to-print time of approximately 6 seconds. Thus, in response to the pause phase trigger, the print controller 120 executing module 208, changes the set-point 140 from a printing temperature set-point to a pause temperature set-point, anticipating and circumventing the blanket temperature overshoot that would otherwise result from the pause in printing. Furthermore, the pause phase temperature set-point can be selected to ensure both a minimum back-to-print time and a constant blanket temperature as the press transitions between a print mode and a pause phase.

As mentioned above, in some examples the set-point 140 of the heating lamp 127 can be a power supply set-point of the heating lamp 127. In such examples, the PID 136 can use the power supply set-point 140 to directly control the power supply 138 for providing particular levels or amounts of power to the heating lamp 127. In such examples, in response to receiving/detecting a pause phase trigger, the print controller 120 can change the set-point 140 of the heating lamp 127 from a printing-power set-point value, to a pause-power set-point value. In such examples, the PID 136 can initially use a sensed temperature value from temperature sensor 134 to verify that a printing temperature set-point has been achieved (e.g., 110° C.). A power level corresponding with the printing temperature set-point can then be determined and registered as a power supply set-point for the heating lamp 127. Thereafter, the PID 136 can control power to the heating lamp 127 directly, without considering the temperature sensed by sensor 134 at the print blanket 124. Such direct control of the power supply 138 may be particularly useful in circumstances where the print controller 120 receives a pause phase trigger that indicates a pause in the printing, because changing a power supply set-point of the heating lamp 127 can provide a more immediate adjustment of the amount of power going to the heating lamp 127. For example, upon receiving a pause phase trigger, an immediate power supply adjustment to decrease power to the heating lamp 127 can help to avoid a temperature overshoot of the print blanket temperature during the pause phase. In general, therefore, control of the blanket temperature can comprise a hybrid process in which the PID 136 uses both a temperature set-point and a power supply set-point. That is, during printing the PID 136 can control the blanket temperature by comparing measured temperatures to a printing temperature set-point to indirectly control power, and during a pause phase the PID 136 can control the blanket temperature by using a power supply set-point to directly control power to the heating lamp 127.

Figure 3:
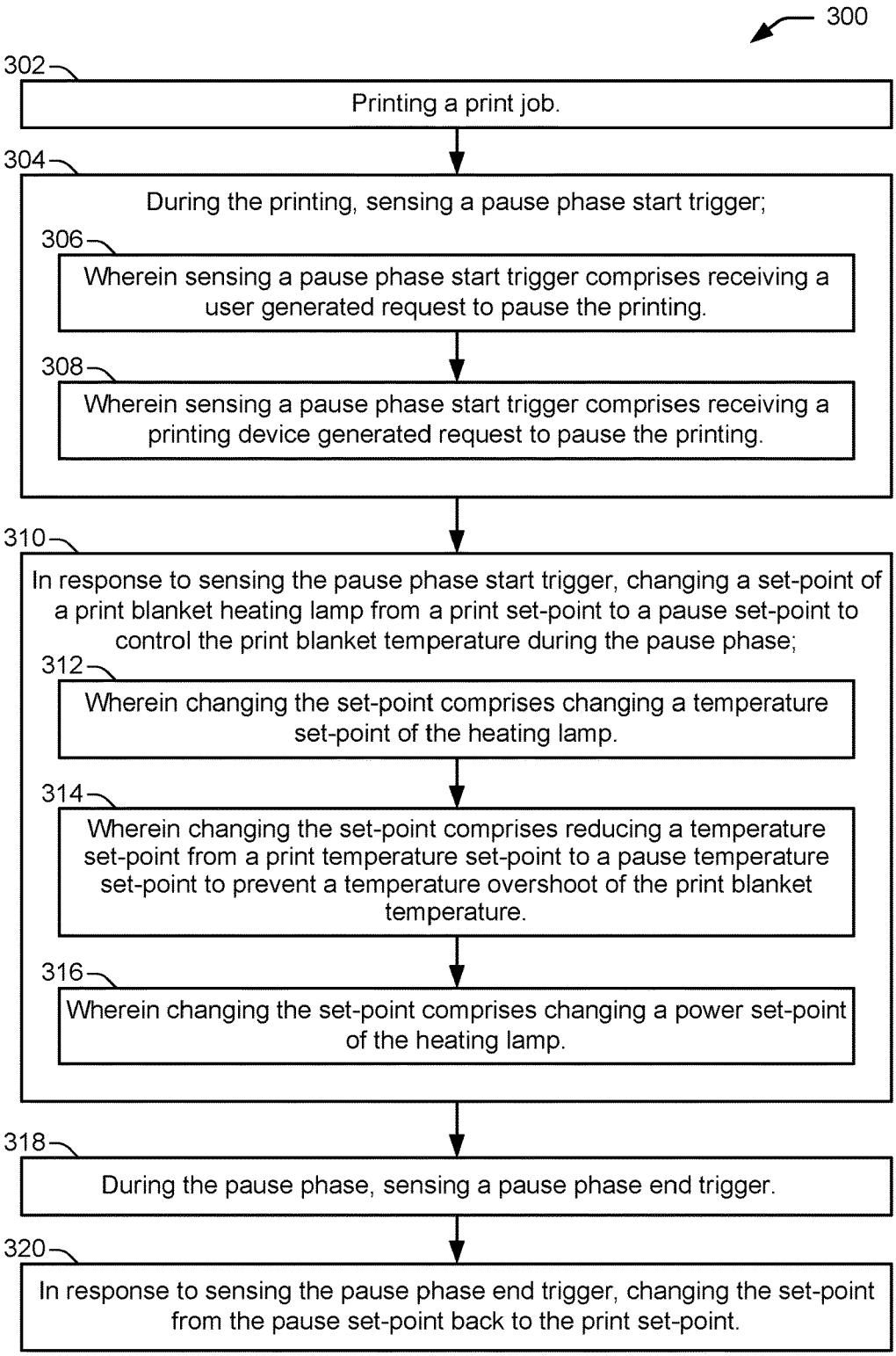
FIGS. 3 and 4 show flowcharts of example methods related to controlling the temperature of a print blanket within a printing device.
Figure 4:
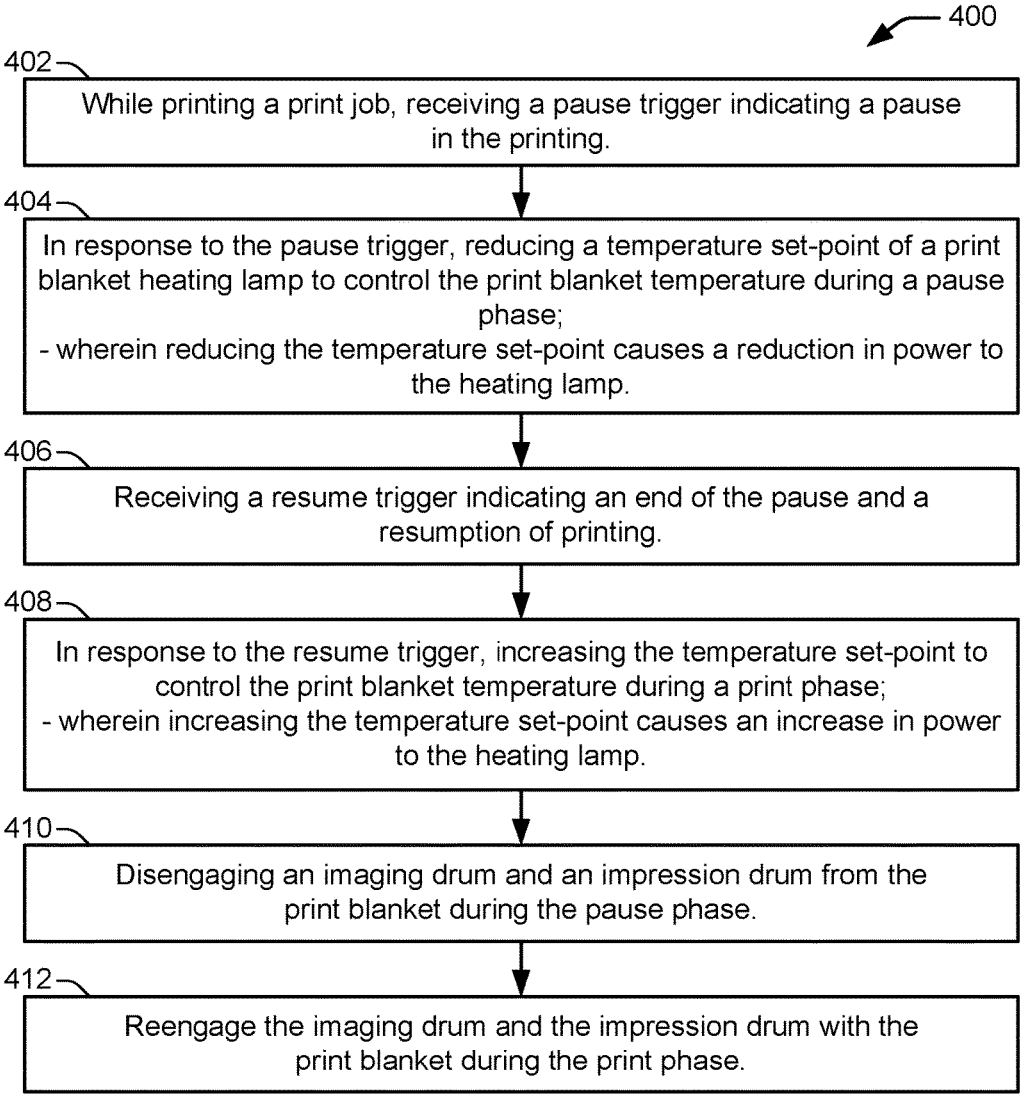

FIGS. 3 and 4 show flow diagrams that illustrate example methods 300 and 400, related to controlling the temperature of a print blanket within an LEP printing press 100 to avoid a temperature overshoot in the blanket that exceeds a normal blanket printing temperature. Methods 300 and 400 are associated with the examples discussed above with regard to FIGS. 1 and 2, and details of the operations shown in methods 300 and 400 can be found in the related discussion of such examples. The operations of methods 300 and 400 may be embodied as programming instructions stored on a non-transitory, machine-readable (e.g., computer/processor-readable) medium, such as memory 202 of printing press 100 as shown in FIGS. 1 and 2. In some examples, implementing the operations of methods 300 and 400 can be achieved by a processor, such as processor 200 of FIG. 2, reading and executing the programming instructions stored in memory 202. In some examples, implementing the operations of methods 300 and 400 can be achieved using an ASIC (application specific integrated circuit) and/or other hardware components alone or in combination with programming instructions executable by processor 200.

Methods 300 and 400 may include more than one implementation, and different implementations of methods 300 and 400 may not employ every operation presented in the respective flow diagrams. Therefore, while the operations of methods 300 and 400 are presented in a particular order within the flow diagrams, the order of their presentation is not intended to be a limitation as to the order in which the operations may actually be implemented, or as to whether all of the operations may be implemented. For example, one implementation of method 300 might be achieved through the performance of a number of initial operations, without performing one or more subsequent operations, while another implementation of method 300 might be achieved through the performance of all of the operations.

Referring now to the flow diagram of FIG. 3, an example method 300 of controlling the temperature of a print blanket within a printing device such as press 100 begins at block 302, with printing a print job. As shown at block 304, during the printing of the print job, the method 300 continues with sensing a pause phase start trigger. The pause phase start trigger indicates a pause in the printing. In different examples, sensing a pause phase start trigger comprises receiving a user generated request to pause the printing and receiving a printing device generated request to pause the printing as shown in blocks 306 and 308, respectively. As shown in block 310 of method 300, in response to sensing the pause phase start trigger, a set-point of a print blanket heating lamp is changed from a print set-point to a pause set-point to control the print blanket temperature during the pause phase. In different examples, changing the set-point of the heating lamp comprises changing a temperature set-point of a heating lamp (block 312), such as reducing the temperature set-point from a print temperature set-point to a pause temperature set-point to prevent a temperature overshoot of the print blanket temperature (block 314). In other examples, as shown at block 316, changing the set-point comprises changing a power set-point of the heating lamp.

The method 300 can continue at block 318 with sensing a pause phase end trigger during the pause phase. A pause phase end trigger indicates the pause in printing is coming to an end, and printing will resume. In response to sensing the pause phase end trigger, as shown at block 320, the method 300 continues with changing the set-point from the pause set-point back to the print set-point. In some examples, a pause phase end trigger may not occur, and a timeout duration for the pause phase will elapse. As noted above, the timeout duration prevents a pause phase from continuing indefinitely or beyond a specified time period, such as five minutes. If the timeout duration elapses prior to receiving a pause phase end trigger, the printing press will transition to a lower state, such as a standby state in which a standby temperature is activated and heating lamps that heat the blanket are turned off.

Referring now to the flow diagram of FIG. 4, an example method 400 related to controlling the temperature of a print blanket within a printing press 100 begins at block 402, with receiving a pause trigger while printing a print job. The pause trigger indicates a pause in the printing. As shown at block 404, the method 400 continues with, in response to the pause trigger, reducing a temperature set-point of a print blanket heating lamp to control the print blanket temperature during a pause phase. In some examples, reducing the temperature set-point causes a reduction in power to the heating lamp. As shown a block 406, a resume trigger is received that indicates an end of the pause phase and a resumption of the printing. In response to the resume trigger, the temperature set-point is increased to control the print blanket temperature during a print phase, as shown at block 408. In some examples, increasing the temperature set-point causes an increase in power to the heating lamp. The method 400 also includes disengaging an imaging drum and an impression drum from the print blanket during the pause phase, and reengaging the imaging drum and the impression drum with the print blanket during the print phase, as shown at blocks 410 and 412, respectively.

What is claimed is:

1. A method of controlling a temperature of a print blanket within a printing device, comprising:

printing a print job;

during the printing, sensing a pause phase start trigger;

disengaging an imaging drum and an impression drum from the print blanket during the pause phase; and in response to the sensing, changing a set-point of a print blanket heating lamp from a print set-point to a pause set-point to control the temperature of the print blanket during the pause phase, the changing of the set-point of the print blanket heating lamp in response to the sensing maintaining, during the pause phase, the temperature of the print blanket that is disengaged from the imaging drum and the impression drum at or below a printing temperature of the print blanket.

2. The method of claim 1, further comprising:

during the pause phase, sensing a pause phase end trigger; and in response to sensing the pause phase end trigger, changing the set-point of the print blanket heating lamp from the pause set-point back to the print set-point.

3. The method of claim 1, wherein changing the set-point of the print blanket heating lamp comprises reducing a temperature set-point from a print temperature set-point to a pause temperature set-point to prevent a temperature overshoot of the temperature of the print blanket.

4. The method of claim 1, wherein sensing the pause phase start trigger comprises receiving a user generated request to pause the printing.

5. The method of claim 1, wherein changing the set-point of the print blanket heating lamp comprises changing a temperature set-point of the print blanket heating lamp.

6. The method of claim 1, wherein changing the set-point of the print blanket heating lamp comprises changing a power set-point of the print blanket heating lamp.

7. A printing device comprising:

an imaging drum comprising a photoreceptor;

an impression drum;

a print blanket to receive an ink image from the photoreceptor and to transfer the ink image to a print media held by the impression drum;

a heating lamp to heat the print blanket and prepare the ink image for transfer to the print media; and a controller to receive a pause phase trigger and to change a set-point of the heating lamp from a print set-point to a pause set-point in response to the pause phase trigger, wherein the imaging drum and the impression drum are to disengage from the print blanket during the pause phase, and the changing of the set-point of the heating lamp in response to the pause phase trigger is to maintain, during the pause phase, a temperature of the print blanket that is disengaged from the imaging drum and the impression drum at or below a printing temperature of the print blanket.

8. The printing device of claim 7, wherein the set-point of the heating lamp comprises a temperature set-point, the printing device further comprising:

a temperature sensor to measure a temperature of the print blanket;

a power supply to provide power to the heating lamp; and a control loop comprising the controller to adjust the power from the power supply to the heating lamp in response to a comparison of the temperature set-point and the measured temperature.

9. The printing device of claim 7, wherein the heating lamp comprises an infrared heating lamp.

10. The printing device of claim 8, wherein the control loop is to adjust the power from the power supply to the heating lamp in response to the comparison of the temperature set-point and the measured temperature during a print phase of the printing device for printing onto the print media, and the controller is to adjust a power from the power supply to the heating lamp in response to a power set-point of the heating lamp set by the controller during the pause phase without considering a temperature measured by the temperature sensor.

11. The printing device of claim 7, wherein the pause phase trigger comprises a user-generated pause phase trigger, the printing device further comprising:

a user interface from which the user-generated pause phase trigger is entered.

12. A non-transitory machine-readable storage medium storing instructions that when executed cause a printing device to:

while printing a print job, receive a pause trigger of a pause phase;

cause disengagement of an imaging drum and an impression drum from a print blanket during the pause phase;

in response to the pause trigger, change a set-point of a print blanket heating lamp from a print set-point to a pause set-point to control a temperature of the print blanket during the pause phase, the changing of the set-point of the print blanket heating lamp in response to the pause trigger to maintain, during the pause phase, a temperature of the print blanket that is disengaged from the imaging drum and the impression drum at or below a printing temperature of the print blanket;

receive a resume trigger;

in response to the resume trigger, change the set-point of the print blanket heating lamp from the pause set-point to the print set-point to control the temperature of the print blanket during a print phase; and reengage the imaging drum and the impression drum with the print blanket during the print phase.

13. The non-transitory machine-readable storage medium of claim 12, wherein:

changing the set-point of the print blanket heating lamp from the print set-point to the pause set-point causes a reduction in power to the heating lamp; and changing the set-point of the print blanket heating lamp from the pause set-point to the print set-point causes an increase in power to the heating lamp.

14. The method of claim 1, further comprising:

receiving a measured temperature of the print blanket from a temperature sensor;

during a print phase of the printing device for printing onto a print media held by the impression drum by transferring an image from the print blanket to the print media, adjusting, by a controller, a power to the print blanket heating lamp in response to comparing the measured temperature from the temperature sensor to the print set-point, and during the pause phase of the printing device, adjusting, by the controller, a power to the heating lamp according to the pause set-point without considering a measured temperature from the temperature sensor.

15. The method of claim 1, wherein the print set-point is a temperature set-point, and the pause set-point is a power set-point.

16. The printing device of claim 7, further comprising:

a temperature sensor to measure a temperature of the print blanket, wherein the controller is to:

during a print phase of the printing device for printing onto the print media, adjust a power to the heating lamp in response to comparing the temperature from the temperature sensor to the print set-point, and during the pause phase of the printing device, adjust a power to the heating lamp according to the pause set-point without considering a temperature from the temperature sensor.

17. The printing device of claim 16, wherein the print set-point is a temperature set-point, and the pause set-point is a power set-point.

18. The printing device of claim 7, wherein the printing device is to transition from the pause phase to a standby phase following a specified time duration of the pause phase, the controller to turn off the heating lamp in the standby phase.

19. The non-transitory machine-readable storage medium of claim 12, wherein the printing device comprises a temperature sensor to measure a temperature of the print blanket, and wherein the instructions when executed cause the printing device to:

during the print phase of the printing device for printing onto a print media held by the impression drum by transferring an image from the print blanket to the print media, adjust a power to the heating lamp in response to comparing the temperature from the temperature sensor to the print set-point, and during the pause phase of the printing device, adjust a power to the heating lamp according to the pause set-point without considering a temperature from the temperature sensor.

20. The non-transitory machine-readable storage medium of claim 12, wherein the printing device is to transition from the pause phase to a standby phase following a specified time duration of the pause phase, and wherein the instructions when executed cause the printing device to turn off the heating lamp in the standby phase.

* * * * *